US006254696B1

(12) United States Patent
Ueda et al.

(10) Patent No.: US 6,254,696 B1
(45) Date of Patent: Jul. 3, 2001

(54) BAINITIC TYPE RAIL EXCELLENT IN SURFACE FATIGUE DAMAGE RESISTANCE AND WEAR RESISTANCE

(75) Inventors: Masaharu Ueda; Kouichi Uchino; Katsuya Iwano; Akira Kobayashi, all of Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/380,992

(22) PCT Filed: Jan. 14, 1999

(86) PCT No.: PCT/JP99/00102

§ 371 Date: Sep. 13, 1999

§ 102(e) Date: Sep. 13, 1999

(87) PCT Pub. No.: WO99/36583

PCT Pub. Date: Jul. 22, 1999

(30) Foreign Application Priority Data

Jan. 14, 1998 (JP) ..... 10-005360

(51) Int. Cl.[7] ..... C22C 38/18; C22C 38/22; C22C 38/40

(52) U.S. Cl. ..... 148/333; 148/334; 148/335; 148/328

(58) Field of Search ..... 148/581, 333, 148/334, 335, 328

(56) References Cited

FOREIGN PATENT DOCUMENTS

| | | |
|---|---|---|
| 59-19173 | 5/1984 | (JP) . |
| 63-23244 | 5/1988 | (JP) . |
| 7-34132 | 2/1993 | (JP) . |
| 5-345955 | 12/1993 | (JP) . |
| 6-158227 | 6/1994 | (JP) . |
| 6-248347 | 9/1994 | (JP) . |
| 6-306528 | 11/1994 | (JP) . |
| 7-34133 | 2/1995 | (JP) . |
| 8-158014 | 6/1996 | (JP) . |

*Primary Examiner*—Deborah Yee
(74) *Attorney, Agent, or Firm*—Kenyon & Kenyon

(57) ABSTRACT

High-strength bainitic steel rails have improved resistances to surface fatigue failures and wear required of the head of rails for heavy-load service railroads. The high-strength bainitic steels rails having excellent resistances to surface fatigue failures and wear contain constituents of specific ranges and consisting of bainitic structures at least in part are characterized in that the total area occupied by carbides whose longer axes are 100 to 1000 nm in a given cross section of said bainitic structures accounts for 10 to 50 percent thereof.

4 Claims, 5 Drawing Sheets

BAINITIC TYPE RAIL EXCELLENT IN SURFACE FATIGUE DAMAGE RESISTANCE AND WEAR RESISTANCE

FIELD OF THE INVENTION

This invention relates to high-strength bainitic steel rails having good resistance to surface fatigue failures, wear and metal flow which the head of rails used for railroad tracking for heavy-load services are required to possess.

BACKGROUND OF THE INVENTION

Heavy-load service railroads overseas have been increasing train speed and load-carrying capacity of freight cars as a means for improving the efficiency of freight transportation services. Such improvements in efficiency have been attended with severer service environments which, in turn, have needed further improvements in the quality of rails. In such environments, concretely, rails used in curved segments of railroads are rapidly worn down in their gauge corner and the side of their head, and such wear seriously impairs the service life of rails. However, high-strength (or high-hardness) rails of eutectoid carbons steels containing fine pearlite can be prepared by the recently developed strengthening heat treatment technologies described below. Such rails have remarkably lengthened the life of rails used in curved segments of heavy-load service railroads.

(1) A process for manufacturing high-strength steel rails having a strength of 130 kgf/mm$^2$ minimum by applying accelerated cooling to the head of as-rolled or reheated rails from the austenite region to temperatures between 850 and 500° C. at a rate of 1 to 4° C. per second. (Japanese Patent Publication No. 23244 of 1988)

(2) A process for manufacturing heat-treated low-alloy steel rails having increased wear resistance and improved weldability (permitting easy welding and forming welded joints having good properties) by adding chromium, niobium and other alloying elements. (Japanese Patent Publication No. 19173 of 1984)

These rails are high-strength rails characterized by the presence of fine pearlitic structures obtained in steels containing eutectoid carbon (with a carbon content of 0.7 to 0.8%). The object of these rails is to increase wear resistance by producing a very fine lamellar spacing in pearlite and, at the same time, improve the properties of welded joints by alloy additions.

In straight and gently curved segments of railroads where there does not constitute a serious problem, conventional as-rolled rails of steels with pearlitic structures and some high-strength heat-treated steels have been used. As service environments have grown severer recently, however, repeated contact of rails with train wheels often cause surface fatigue failures in their rolling surfaces. Cracks in the surface of rail heads called "head surface shelling" or "dark spot" are considered particularly important. Cracks of this type occurring in the head surface of rails, propagating to the inner part of their head, and branching to their base sometimes cause transverse fissures in rails for heavy-load services.

It has been known that this dark-spot cracking occurs not only in rails for heavy-load services but also in those for high-speed passenger transportation. The dark-spot cracking is thought to result from the accumulation of fatigue-damaged layers (where pearlite lamellae are ruptured) in the surface of rail heads through the repeated contact of rails with train wheels and the occurrence of slip in the ferrite phase of the pearlitic structure caused by the development of texture (where crystal faces of crystal grains are oriented in the same direction).

This problem can be solved by removing the fatigued layers (fatigue-damaged layer and texture) by grinding off the surface of the rail head. However, grinding that must be done at regular intervals is costly and labor-intensive.

Another solution is to decrease the hardness of the surface of the rail head so that the surface is removed by wear before the fatigued layer is formed. When the hardness of the rail head surface is simply decreased, however, some plastic flow tends to occur in the surface of the rail head directly below the running wheels of the train. The metal flow is oriented in a direction opposite to that of travel of the train running thereover. Then, cracks tend to occur along the metal flow.

The inventors experimentally verified the relationship between the formation of the fatigued layers (fatigue-damaged layer and texture) resulting from the repeated contact of rails with train wheels and the metal structure. The verification study revealed that fatigued layers tend to accumulate and textures tend to develop in pearlitic structures in which ferrite and cementite phases are layered. In bainitic structures in which hard granular carbides are dispersed in the soft matrix of ferritic structures, in contrast, the incidence of accumulation of fatigue-damaged layers and development of textures triggering surface fatigue failures in the metal surface is low, entailing a lower incidence of dark spots.

With heavy-load service railroads overseas, pressures and traction forces at the contact surfaces between rails and wheels are high. Rails made of steels having bainitic structures can prevent dark spots and other fatigue failures in their surface. However, increased wear shorten the service life of rails and increases the incidence of metal flow in the surface of rail heads directly below train wheels. Particularly in gently curved segments where large traction forces are developed, the incidence of other types of fatigue failures in the surface, such as head checks cracks and flaking in gauge corners, increases.

To solve these problems, the inventors sought to devise a method for increasing the strength of bainitic structures. The strength of bainitic steels is governed by the hardness of the ferrite matrix and carbides and the size of carbides in bainitic structures. Generally, the strength of bainitic steels is increased by (1) increasing the hardness of the ferrite matrix and carbides by giving large alloy additions, and (b) reducing the size of carbides by controlling the bainite transformation temperature.

However, large alloy additions required for increasing the hardness of the ferrite matrix and carbides are costly. At the same time, increased hardenability forms martensitic and other structures detrimental to the toughness of rails when they are welded. Although, on the other hand, reduction in the size of carbides increases strength, it is difficult to secure the required wear resistance if the size and quantity of carbides are improper.

By focusing attention on bainitic structures in which fatigued layers (surface fatigue damage and textures) are difficult to form, the inventors sought a method for improving resistances to wear and metal flow without requiring large alloy additions. Specifically, the optimum size for carbides to be achieved by size control was experimentally verified.

It was revealed that when the carbides in bainitic structures are larger than a certain size wear resistance decreases and metal flow causes cracks and other damages. When the carbides in bainitic structures are smaller than a certain size, on the other hand, it is difficult for hard carbides that contributes to the attainment of wear resistance of bainitic steels to accumulate beneath rolling surfaces. Thus, sufficient improvement in wear resistance is difficult to achieve.

In addition to these studies, the inventors also verified the quantity of carbides of the optimum size required for improving resistance to wear and metal flow. This study revealed that when the area occupied by hard carbides of optimum size in a given cross section becomes smaller than a certain limit it is difficult for hard carbides contributing to the attainment of wear resistance of bainitic steels to accumulate beneath rolling surfaces, entailing the lowering of wear resistance. When the quantity of hard carbides of optimum size exceeds a certain limit, on the other hand, ductility of bainitic structures decreases and the incidence of spalling and other flaking failures increases.

Based on these studies, the inventors empirically discovered that bainitic structures having good resistance to surface fatigue failures and wear can be obtained by controlling the size of carbides in bainitic structures and the area occupied by such carbides in a given cross section within certain ranges.

Thus, the object of this invention is to provide high-strength rails having good resistances to surface fatigue failure, wear and metal flow required of heavy-load service railroads at low cost by employing the knowledge obtained by the studies described above.

SUMMARY OF THE INVENTION

This invention achieves the above object as described below.

Rails according to this invention are made of steels at least partly comprising bainitic structures, having good resistance to surface fatigue failures and wear, and characterized in that the total area occupied by carbides whose longer axis is between 100 and 1000 nm in a given cross section of the bainitic structure is between 10 and 50 percent.

The bainitic steels for the rails of this invention consist, by weight, of 0.15 to 0.45 percent carbon, 0.10 to 2.00 percent silicon, 0.20 to 3.00 manganese, and 0.20 to 3.00 percent chromium, with the remainder consisting of iron and unavoidable impurities.

The bainitic steels for the rails of this invention may also contain one or more of 0.01 to 1.00 percent molybdenum, 0.05 to 0.50 percent copper, 0.05 to 4.00 percent nickel, 0.01 to 0.05 percent titanium, 0.01 to 0.30 percent vanadium, 0.005 to 0.05 percent niobium, 0.0001 to 0.0050 percent boron, 0.0010 to 0.0100 percent magnesium and 0.0010 to 0.0150 percent calcium.

Furthermore, it is preferable that the rails of this invention have bainitic structures in the regions at least 20 mm deep from the corners and the top surface of the rail head.

PREFERRED EMBODIMENTS OF THE INVENTION

A detailed description of the invention is given below.

The reasons why the size of carbides in bainitic structures and the area occupied by carbides in a given cross section are limited will be discussed first.

Figure 6:
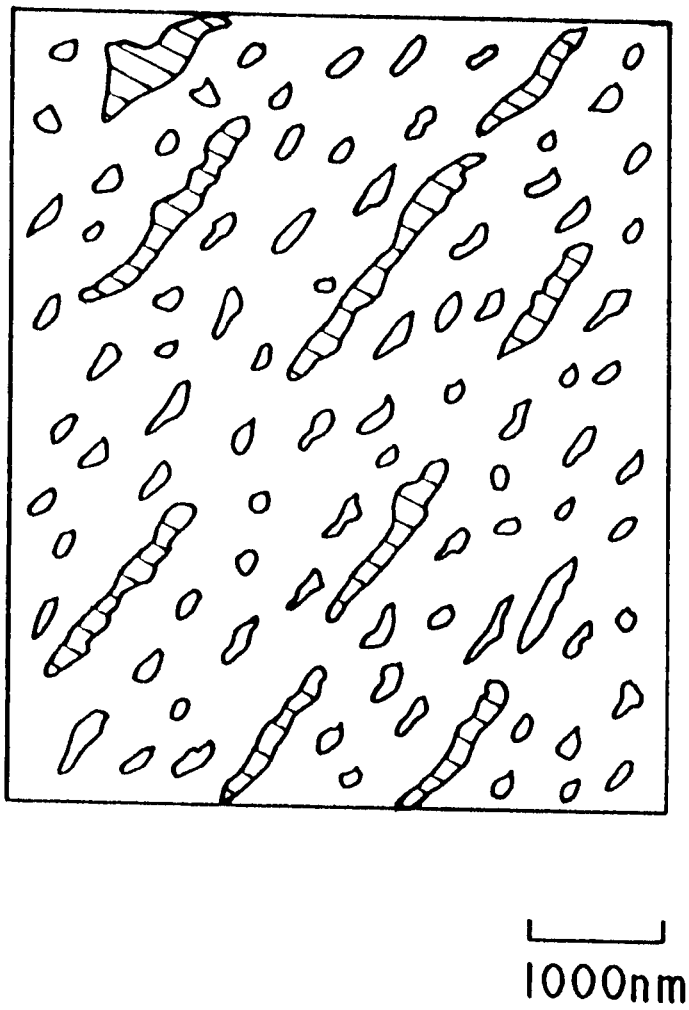
FIG. 6 shows an example of bainitic structures.

FIG. 6 schematically illustrates the cross section of a bainitic structure. In FIG. 6, hollow (shorter ones with the longer axis between 100 and 1000 nm) and hatched (longer ones with the longer axis of over 1000 nm) islands are carbides. Those with the longer axis shorter than 100 nm are not shown. The longer axis of carbides as used here means the distance between both ends of the longer axis thereof.

The size of carbides in bainitic structures is an important factor determining the wear resistance and strength thereof. The longer axis of carbides is limited to 1000 nm maximum because bainitic structures undergo heavy wear entailing a significant shortening of rail life. The incidence of metal flow increases in the surface of the rail head directly below the running train wheels. In addition, head checks cracks and spalling and other flaking failures in gauge corners will occur in gently curved segments where great traction forces are present. When the longer axis of carbides in bainitic structures is shorter than 100 nm, it is difficult for hard carbides contributing to wear resistance to accumulate directly below the rolling surface. Then, carbides are worn off with the ferrite matrix and, as a consequence, the required wear resistance is unobtainable. This is the reason why the longer axis of carbides is limited to 100 nm minimum.

The area occupied by fine carbides (with the longer axis of 100 to 1000 nm) in bainitic structures is an important factor determining the ductility and wear resistance thereof. When the area occupied by fine carbides exceeds 50 percent, the ductility of bainitic structures drops, thereby increasing the incidence of spalling and other flaking failures. So, the area occupied by fine carbides is limited to 50 percent maximum. When the area occupied by fine carbides in bainitic structures is less than 10 percent, hard carbides contributing to the wear resistance of bainitic steels do not accumulate sufficiently directly below the rolling surface. This is the reason why the area occupied by carbides is limited to 10 percent minimum. To obtain sufficient wear resistance and ductility in bainitic structures and improved rail life, it is preferable to limit the area occupied by fine carbides between 20 and 40 percent.

The size of carbides in bainitic structures and the area occupied by them are determined by observing the surface of steel etched with nital, picral or other etchants with the scanning electron microscope. Or, otherwise, thin films of steel are prepared for observation with the transmission electron microscope whereby the longer axis of each carbide in the field of vision. Then, the carbides whose longer axes are between 100 and 1000 nm are selected and the area occupied them is determined by elliptic approximation.

Because the form and density of carbides vary considerably with fields of vision, it is desirable to observe at least ten fields of vision and determine the longer axis of carbides and the area occupied by them by averaging the data obtained from the observation of such multiple fields of vision.

Now the reasons for limiting the desirable ranges of chemical composition for rails will be described below.

Carbon is an element essential for the attainment of bainitic structures with adequate strength and wear resistance. When carbon content is below 0.15 percent, it is difficult to obtain strength required of bainitic structures. With the resulting reduction in the quantity of carbides contained in bainitic structures, it is difficult for hard carbides contributing to wear resistance to accumulate beneath the rolling surface. When carbon content exceeds 0.45 percent, on the other hand, the incidence of pearlitic structures tending to cause surface damages in bainitic structures increases and increased carbides lower the ductility of bainitic structures. All this increases the incidence of spalling and other flaking failures in the rolling surface. Therefore, carbon content is limited between 0.15 and 0.45 percent.

Silicon increases the strength of bainitic structures by solid solution hardening of the ferrite matrix. However, this effect is unattainable when silicon content is under 0.10 percent. When silicon content exceeds 2.0 percent, the incidence of surface defects during hot-rolling of rails increases. Also, martensitic structures formed in bainitic structures are detrimental to the toughness and resistance to wear and metal flow of rails. Thus, silicon content is limited between 0.10 and 2.00 percent.

Manganese lowers the bainite transformation temperature, increases the hardness of carbides, and contributes to strengthening of steel. However, this effect is unattainable when manganese content is under 0.20 percent. With manganese content under 0.20 percent, it is difficult to attain the strength required of bainitic steel rails. When manganese content exceeds 3.00 percent, on the other hand, carbides in bainitic structures become too hard, the ductility and transformation rate of bainitic structures drop, the incidence of martensitic structures detrimental to the wear resistance, toughness and resistance to metal flow of rails increases. As such, manganese content is limited between 0.20 and 3.00 percent.

Chromium, which finely disperses carbides and increases the hardness of the ferrite matrix and carbide in bainitic structures, is an important element for the attainment of desired strength. However, this effect is unattainable when chromium content is under 0.20 percent. With chromium content under 0.20 percent, it is difficult to attain the strength required of bainitic steel rails. When chromium content exceeds 3.00 percent, on the other hand, carbides in bainitic structures become too hard, the ductility and transformation rate of bainitic structures drop, the incidence of martensitic structures detrimental to the wear resistance, toughness and resistance to metal flow of rails increases, as in the case of manganese. Therefore, chromium content is limited between 0.20 and 3.00 percent.

To improve strength, ductility and toughness and prevent deterioration by welding, one or more of the elements described below may be added. Molybdenum, copper and boron increase strength, vanadium and niobium increase strength and toughness, nickel, titanium, magnesium and calcium increase ductility and toughness, and molybdenum prevents deterioration by welding. Choices can be made depending on goals desired. The percent ranges of individual elements are as given below.

Molybdenum: 0.01 to 1.00%

Copper: 0.05 to 0.50%

Nickel: 0.05 to 4.00%

Titanium: 0.01 to 0.05%

Vanadium: 0.01 to 0.30%

Niobium: 0.005 to 0.05%

Boron: 0.0001 to 0.0050%

Magnesium: 0.0010 to 0.010%

Calcium: 0.0010 to 0.0150%

The reasons for limiting the percent ranges of the listed elements are given below.

Molybdenum, like manganese and chromium, lowers the bainite transformation temperature, contributes to the stabilization of bainite transformation and strengthening of bainitic structures, and strengthens carbides in bainitic structures. However, this effect is inadequate when molybdenum content is under 0.01 percent. When molybdenum content exceeds 1.00 percent, on the other hand, the transformation rate of bainitic structures drops significantly and the incidence of martensitic structures detrimental to toughness and resistance to wear and metal flow increases, as in the case of manganese and chromium. Therefore, molybdenum content is limited between 0.01 and 1.00 percent.

Copper increases strength of steel without impairing toughness. While this effect reaches maximum when copper content is between 0.05 and 0.50 percent, red-hot shortness occurs when copper content exceeds 0.50 percent. Thus, copper content is limited between 0.05 and 0.50 percent.

Nickel stabilizes austenite, lowers the bainite transformation temperature, refines bainitic structures, and improves ductility and toughness. While this effect is very small when nickel content is under 0.05 percent, nickel addition in excess of 4.00 percent does not add to the effect. Therefore, nickel content is limited between 0.05 and 4.00 percent.

Titanium permit refining austenite grains in rolling and heating and increasing ductility and toughness of bainitic structures because titanium carbonitrides precipitated when steel melts and solidifies remain unmelted when rails are reheated for rolling. However, the effect is small when titanium content is under 0.01 percent. Titanium addition in excess of 0.05 percent, on the other hand, forms coarse titanium carbonitrides that serve as the starting point of fatigue failures in service that, in turn, lead to cracking. Thus, titanium content is limited between 0.01 and 0.05 percent.

Vanadium increases strength by precipitation hardening of vanadium carbonitrides formed in the cooling process following hot rolling, refines austenite grains by inhibiting the growth of crystal grains when steel is heated to high temperatures, and improves strength and toughness of bainitic structures. However, the effect is insufficient when vanadium content is under 0.01 percent. Vanadium addition in excess of 0.30 percent, on the other hand, does not add to the effect. Therefore, vanadium content is limited between 0.01 and 0.30 percent.

Niobium, like vanadium, refines austenite grains by forming niobium carbonitrides. The effect of niobium to inhibit the growth of austenite grains reaches into a higher-temperature region (in the vicinity of 1200° C.) than that of vanadium. Niobium also improves toughness of bainitic structures. However, the effect is unobtainable when niobium content is under 0.005 percent, whereas addition in access of 0.05 percent lowers toughness by forming intermetallic compounds and coarse precipitates of niobium. Therefore, niobium content is limited between 0.005 and 0.50 percent. The desirable lower limit of niobium content is 0.01 percent.

Boron assures stable formation of bainitic structures by inhibiting the production of proeutectoid ferrite from prior austenite grain boundaries. However, the effect is small when boron content is under 0.0001 percent, whereas boron addition in excess of 0.0050 percent deteriorates rails by forming coarse compounds of boron. Therefore, boron content is limited between 0.0001 and 0.0050 percent. The desirable lower limit of boron content is 0.0005 percent.

Forming fine oxides by combining with oxygen, sulfur and/or aluminum, magnesium inhibits the growth of crystal grains when steel is reheated for rail rolling, refines austenite grains, and improves ductility of pearlitic structures. Magnesium oxide and magnesium sulfide finely disperse manganese sulfide, form dilute layers of manganese around manganese sulfide, and accelerate the transformation of ferrite constituting the matrix of bainitic structures, thereby improving ductility and toughness of bainitic structures by refining them. However, the effect is small when magnesium content is under 0.0010 percent, whereas magnesium addition in excess of 0.0100 percent forms coarse oxides of magnesium that deteriorate ductility and toughness of rails. Thus, magnesium content is limited between 0.0010 and 0.0100 percent.

Calcium combines strongly with sulfur and forms calcium sulfide. Calcium sulfide finely disperses manganese sulfide, forms dilute zones of manganese around manganese sulfide, and makes contribution to the formation of ferrite constituting the matrix of bainitic structures, thereby improving ductility and toughness of bainitic structures through the refinement of bainitic structures. However, the effect is small when calcium content is under 0.0010 percent, whereas calcium addition in excess of 0.0150 percent forms coarse oxides of calcium and deteriorate ductility and toughness of rails. Therefore, calcium content is limited between 0.0010 and 0.0150 percent.

Rail steels of the above compositions are manufactured by melting in basic oxygen, electric or other ordinary steelmaking furnaces. The obtained molten steels are made into semi-finished steels by a combination of ingot-casting and blooming processes or continuous casting, and the semi-finished steels are then hot-rolled into rails. By applying heat treatment to the head of hot rails as hot-rolled or reheated, hard bainitic structures are stably formed in rail heads.

The reason why the regions having the desirable bainitic structures are confined to the regions at least 20 mm deep from the corners and the top surface of the rail head is given below. The depth smaller than 20 mm is too small to provide the resistance to wear and surface fatigue failures required of rail heads. If the region having said bainitic structures are more than 30 mm deep from the corners and top head of the rail head, the rail life will be lengthened further.

Figure 1:
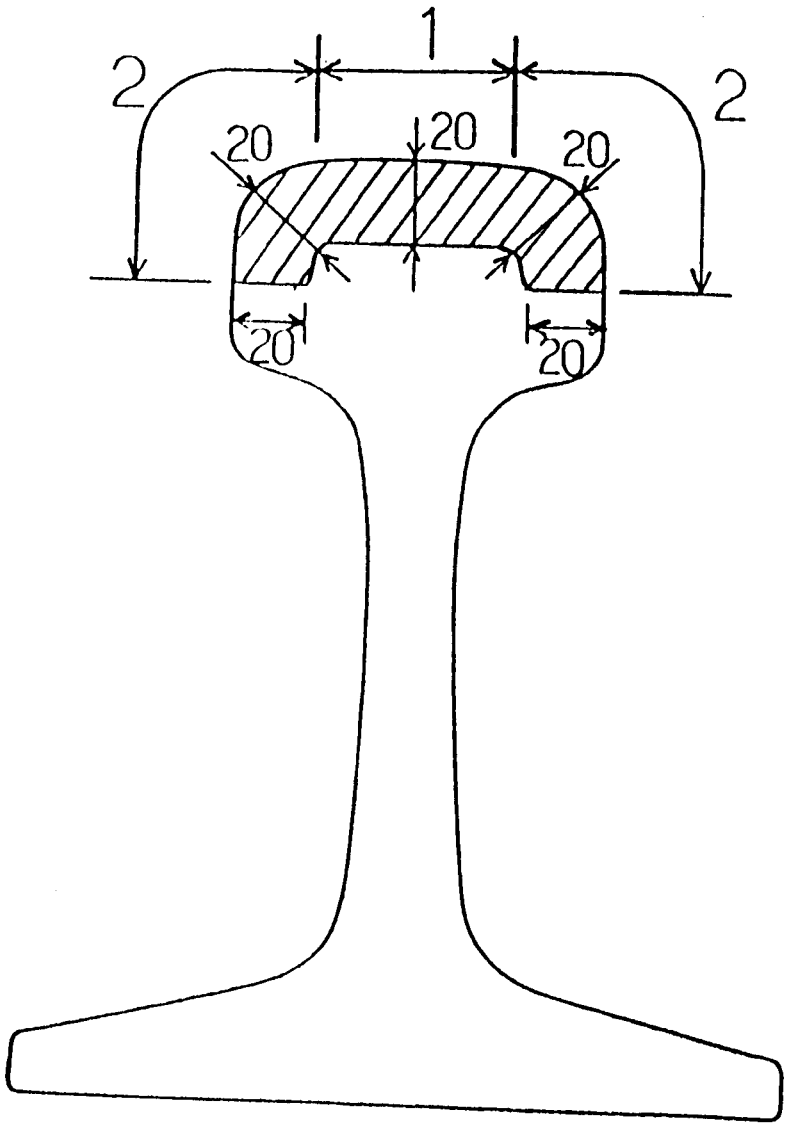
FIG. 1 shows the nomenclature for the cross section of the rail head.
Figure 2:
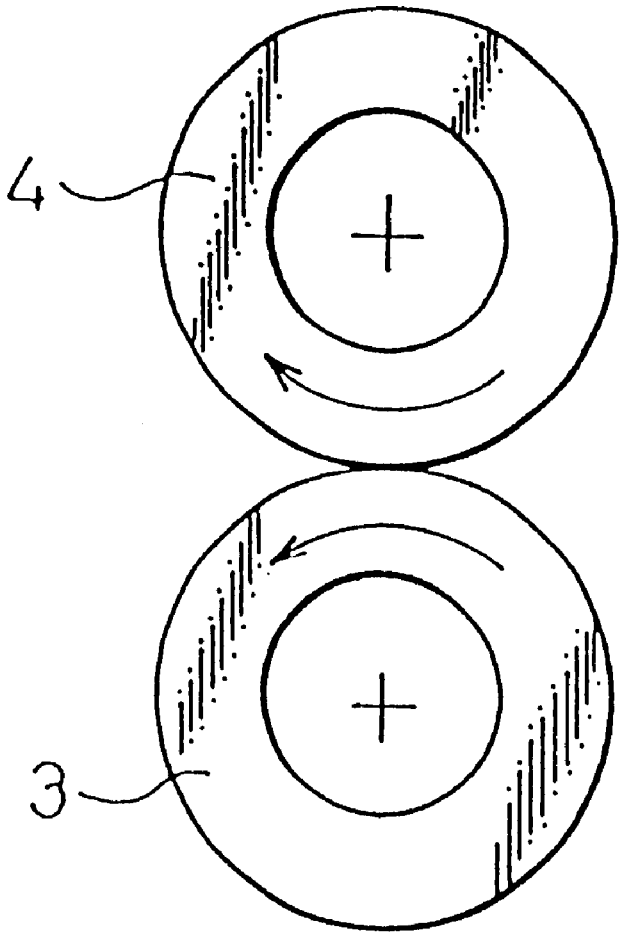
FIG. 2 is a schematic view of the Nishihara wear tester.

Now, the nomenclature of the head of bainitic steel rails having excellent resistances to wear and surface fatigue failures is illustrated in FIG. 1, along with the regions requiring good resistances to wear and surface fatigue failures. In the rail head shown in FIG. 1, reference numeral 1 designates the top of the rail head and 2 denotes the corners thereof. One of the corners 2 is the gauge corner that comes into contact with the train wheel. The service life of rails can be improved if said bainitic structures are present at least in the hatched regions in the illustration (which are 20 mm deep from the surface).

It is preferable that rails according to this invention are made of steels of bainitic structures. Depending on manufacturing processes, however, small quantities of martensitic structures are mixed in bainitic structures. However, small quantities of martensitic structures mixed in bainitic structures do not have any significant influence on toughness and resistances to wear and surface fatigue failures of rails. Therefore, the bainitic steel rails according to this invention may contain some martensitic structures.

Embodiments

Some embodiments of this invention will be described below.

Figure 3:
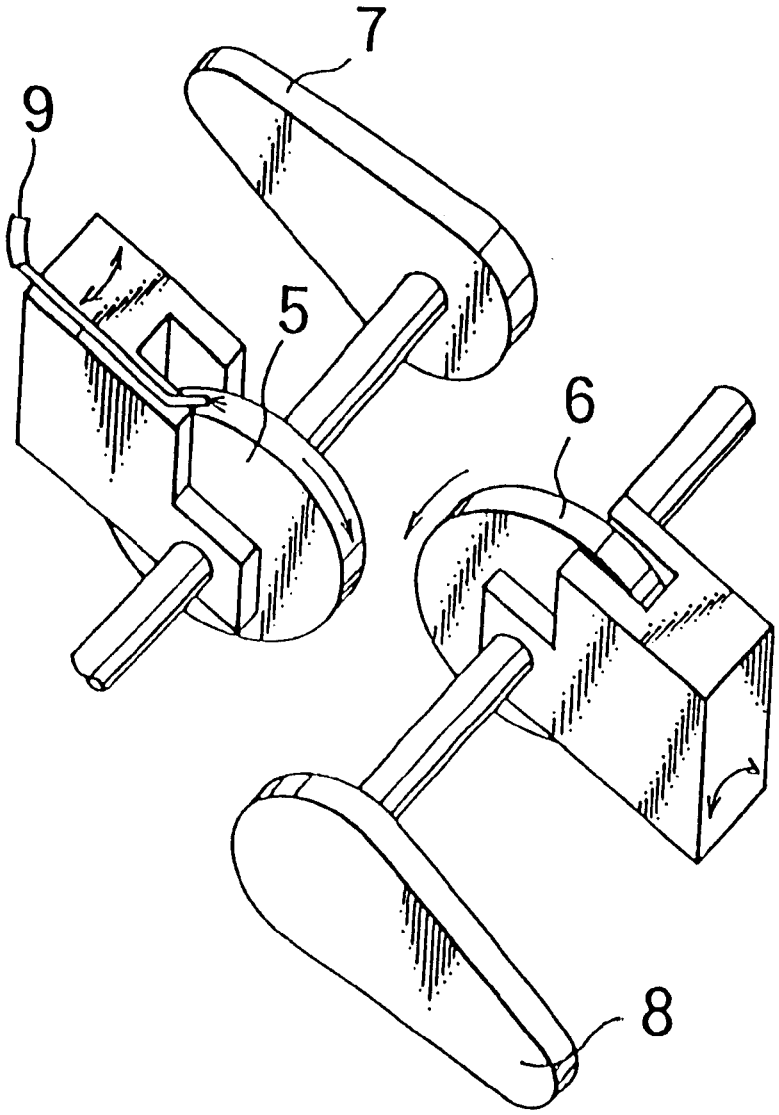
FIG. 3 is a schematic view of a rolling fatigue damage tester.

Tables 1 and 2 show the chemical compositions, microstructures, the range of the long axes of carbides in a given cross section of bainitic structures, and the area occupied by carbides with long axes between 100 and 1000 nm of rail steels according to this invention and conventional rail steels compared therewith. All rail steels contain iron and unavoidable impurities in addition to the constituents given in the tables. Tables 1 and 2 also show the results of wear testing conducted on the rail heads using the Nishihara wear tester and the incidence of surface fatigue failures in the water-lubricated rolling fatigue damage test done on the disk specimens prepared by reducing the size of the rail and wheel to one-fourth the one shown in FIG. 3.

TABLE 1

| Rails | Reference Character | Chemical Composition (Percent by Weight) C | Si | Mn | Cr | Other alloy additions | Micro-structure of Rail Head | Range of Long Axes of Carbides in a Given Cross Section *Maximum to Minimum (nm) | Area Occupied by Carbides Whose Longer Axes Are 100 to 1000 nm in a Given Cross Section (%) | Wear in Rail Head ($g/50 \times 10^4$ times) | Incidence of Fatigue Failure in the Surface ($\times 10^4$ times) |
|---|---|---|---|---|---|---|---|---|---|---|---|
| Rails according to this invention | A | 0.17 | 1.82 | 1.45 | 1.21 | B:0.017 | Bainite | 200–2600 | 11 | 1.51 | 200, No damage |
| | B | 0.22 | 0.35 | 2.91 | 0.64 | V:0.04 | Bainite | 150–1600 | 18 | 0.81 | 200, No damage |
| | C | 0.22 | 0.81 | 0.84 | 2.84 | Nb:0.04 | Bainite | 300–1800 | 16 | 0.87 | 200, No damage |
| | D | 0.29 | 0.25 | 1.51 | 0.24 | Mo:0.31 Ca:0.0025 | Bainite | 450–3900 | 19 | 0.96 | 200, No damage |
| | E | 0.30 | 0.31 | 1.54 | 1.51 | | Bainite | 200–2100 | 25 | 0.77 | 200, No damage |
| | F | 0.34 | 0.21 | 1.24 | 1.64 | Ni:0.21 Mg:0.0025 | Bainite | 150–2400 | 27 | 0.46 | 200, No damage |
| | G | 0.35 | 0.31 | 1.62 | 0.80 | Mo:0.21 | Bainite | 100–2400 | 32 | 0.43 | 200, No damage |
| | H | 0.42 | 0.30 | 1.19 | 1.25 | Mo:0.28 | Bainite | 120–2200 | 37 | 0.24 | 200, No damage |
| | I | 0.41 | 0.17 | 1.66 | 1.35 | Ti:0.04 | Bainite | 30–1500 | 40 | 0.23 | 200, No damage |
| | J | 0.43 | 1.01 | 1.41 | 1.85 | Cu:0.21 | Bainite | 20–1200 | 48 | 0.18 | 200, No damage |
| | K | 0.45 | 0.35 | 0.22 | 2.10 | | Bainite | 500–3500 | 24 | 0.38 | 200, No damage |

TABLE 2

| Rails | Reference Character | Chemical Composition (Percent by Weight) C | Si | Mn | Cr | Other alloy additions | Micro-structure of Rail Head | Range of Long Axes of Carbides in a Given Cross Section *Maximum to Minimum (nm) | Area Occupied by Carbides Whose Longer Axes Are 100 to 1000 nm in a Given Cross Section (%) | Wear in Rail Head (g/50 × $10^4$ times) | Incidence of Fatigue Failure in the Surface (× $10^4$ times) |
|---|---|---|---|---|---|---|---|---|---|---|---|
| Conventional rails compared | L | 0.71 | 0.25 | 0.75 | — | — | Pearlite | | | 1.25 | 125 Dark spots |
| | M | 0.77 | 0.21 | 0.91 | 0.17 | — | Pearlite | | | 0.84 | 102 Dark spots |
| | N | 0.77 | 0.52 | 1.07 | 0.21 | — | Pearlite | | | 0.25 | 74 |
| Dark spots | O | 0.54 | 0.35 | 1.13 | 1.44 | — | Pearlite + bainite | 0.54 | 120 | | Dark spots |
| | P | 0.33 | 2.54 | 0.81 | 1.21 | Mo:0.15 | Bainite + martensite | | | 1.54 Heavy wear | 164 Spalling |
| | Q | 0.35 | 0.41 | 3.41 | 0.40 | Mo:0.15 | Bainite + martensite | | | 1.4 Heavy wear | 121 Spalling |
| | R | 0.35 | 0.25 | 0.81 | 3.21 | — | Bainite + martensite | | | 1.32 Heavy wear | 87 Spalling |
| | S | 0.31 | 0.31 | 1.24 | 1.23 | Mo:0.21 | Bainite | 800–5000 Size of carbides: large | 5 | 3.31 Heavy wear | 54 Flaking |
| | T | 0.21 | 0.41 | 2.14 | 1.78 | — | Bainite | 20–300 Size of carbides: Small | 9 | 1.45 Heavy wear | 200 No damage |
| | U | 0.44 | 0.31 | 1.45 | 1.22 | — | Bainite | 120–1100 | 61 Size of carbides: large | 0.19 | 145 Spalling |
| | V | 0.16 | 0.51 | 1.24 | 1.81 | Mo:0.45 | Bainite | 160–950 | 8 Size of carbides: Small | 1.61 Heavy wear | 200 No damage |

Figure 4:
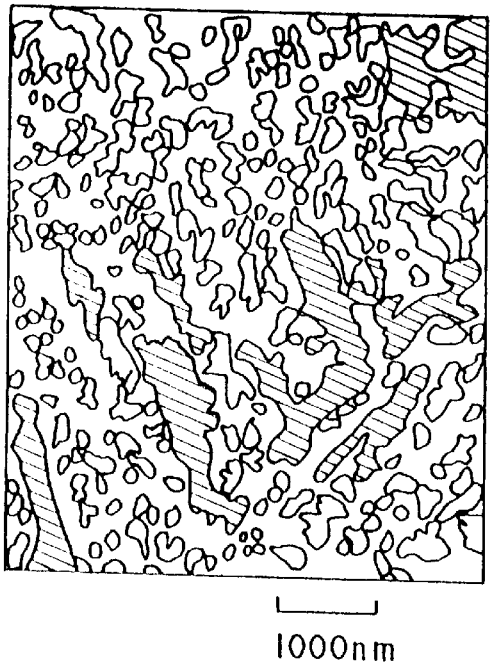
FIG. 4 shows the condition of bainitic structure in a rail steel according to this invention.
Figure 5:
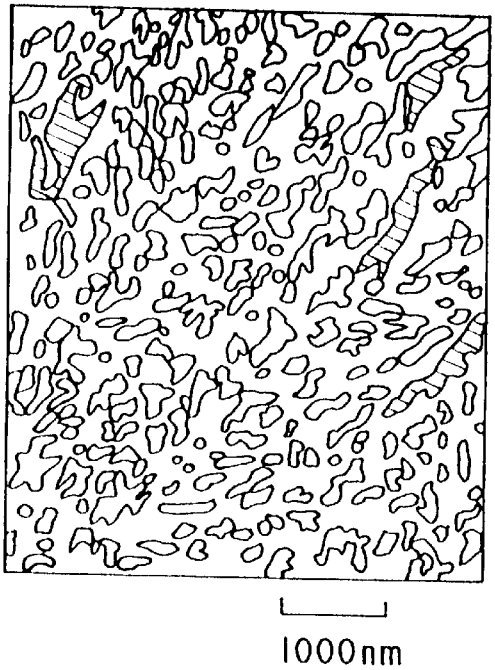
FIG. 5 shows the condition of bainitic structure in another rail steel according to this invention.

FIGS. 4 and 5 shows the microstructures of the cross sections of bainitic structures of rail steels of this invention designated by G and H and magnified 5000 times. The cross sections shown in FIGS. 4 and 5 were obtained by etching the rail steels in a 5 percent nital solution and observed with a scanning electron microscope. The white granules (with longer axes between 100 and 1000 nm) and hatched larger masses (with longer axes over 1000 nm) are carbides in bainitic structures. Carbides with longer axes of under 100 nm are not shown.

The rail steels in Tables 1 and 2 have the following compositions.

Rail steels according to this invention (11 in number and designated by reference characters A to K): Rails steels having compositions within the range according to this invention and bainitic structures. The total area occupied by carbides with longer axes between 100 and 1000 nm in a given cross section of said bainitic structures accounts for 10 to 50 percent of said given cross section.

Conventional rail steels compared with those of this invention (11 in number and designated by reference characteristics L to V): Conventional rail steels of pearlitic structures containing eutectoid carbon (designated by reference characters L to N) and rails steels whose compositions are outside the range of this invention (designated by reference characters O to R). Rails steels having compositions within the range of this invention and bainitic structures. The total area occupied by carbides with longer axes between 100 and 1000 nm in a given cross section of said bainitic structures accounts for over 50 percent or under 10 percent of said given cross section (designated by reference characters S to V).

The wear and rolling fatigue tests were conducted under the following conditions:

[Wear Test]

Testing machine:

Nishihara wear tester

Test specimen:

Disk-shaped specimen (30 mm in outside diameter and 8 mm thick)

Testing load:

490 N

Slip ratio:

9%

Abraded with:

Tempered martensitic steel (HV 350)

Atmosphere:

Ambient air

Cooling:

None

Number of repetitions:

500,000 times

[Rolling Fatigue Damage Test]

Testing machine:

Rolling fatigue failure tester

Test specimen:

Disk-shaped specimen (200 mm in outside diameter, cross-sectional profile of rail: ¼ model of 60 K rail)

Testing load:

2.0 ton (radial load)

Atmosphere:

Dry+water-lubricated (60 cc/min)

Number of rotations:

Dry (0 to 5000 times): 100 rpm

Dry+water-lubricated (5000 times and above): 300 rpm

Number of repetitions:

From 0 to 5000 times in the dry state, and then up to 2 million times or until damage occurs in the water-lubricated state The rail steels according to this invention (designated by A to K) in which the size of carbides in bainitic structures and the area occupied by them are controlled did not develop dark sports that occurred in the conventional steels having pearlitic structures (designated by L to N) which exhibiting wear resistances substantially equal to those of the conventional steels.

Keeping the compositions of the rails steels according to this invention in the given ranges prevented the formation of pearlitic and martensitic structures detrimental to resistances to surface fatigue failures and wear that were found in the rail steels compared (designated by O to R). Controlling the size of carbides in bainitic structures and the area occupied by them significantly improved resistances to wear and surface fatigue failures as compared with those of the rail steels compared (designated by S to V).

Industrial Applicability

As described above, this invention provides high-strength rails for heavy-load service railroads having improved resistances to surface fatigue failures and wear.

What is claimed is:

1. A bainitic steel rail having excellent resistances to surface fatigue failures and wear containing, by weight, 0.15 to 0.45 percent carbon, 0.10 to 2.00 percent silicon, 0.20 to 3.00 percent manganese, and 0.20 to 3.00 percent chromium, with the remainder consisting of iron and unavoidable impurities and consisting of bainitic structures at least in part that is characterized in that the total area occupied by carbides whose longer axes are 100 to 1000 nm in a given cross section of said bainitic structures accounts for 10 to 50 percent thereof by area.

2. A bainitic steel rail having excellent resistances to surface fatigue failures and wear containing, by weight, 0.15 to 0.45 percent carbon, 0.10 to 2.00 percent silicon, 0.20 to 3.00 percent manganese, and 0.20 to 3.00 percent chromium, plus one or more elements selected from the group of 0.01 to 1.00 percent molybdenum, 0.05 to 0.50 percent copper, 0.05 to 4.00 percent nickel, 0.01 to 0.05 percent titanium, 0.01 to 0.30 percent vanadium, 0.005 to 0.05 percent niobium, 0.0001 to 0.0050 percent boron, 0.0010 to 0.0100 percent magnesium, and 0.0010 to 0.0150 percent calcium, with the remainder consisting of iron and unavoidable impurities and consisting of bainitic structures at least in part that is characterized in that the total area occupied by carbides whose longer axes are 100 to 1000 nm in a given cross section of said bainitic structures accounts for 10 to 50 percent thereof by area.

3. A bainitic steel rail having excellent resistances to surface fatigue failures and wear according to claim 1 that is characterized in that the regions at least 20 mm deep from the corners and the top surface of the rail head are of bainitic structures.

4. A bainitic steel rail having excellent resistances to surface fatigue failures and wear according to claim 3 that is characterized in that the regions at least 20 mm deep from the corners and the top surface of the rail head are of bainitic structures.

* * * * *

UNITED STATES PATENT AND TRADEMARK OFFICE

CERTIFICATE OF CORRECTION

PATENT NO. : 6,254,696 B1
DATED : July 3, 2001
INVENTOR(S) : Masaharu Ueda et al.

It is certified that error appears in the above-identified patent and that said Letters Patent is hereby corrected as shown below:

Column 12,
Line 34, change "… claim 3 …" to -- … claim 2 … --.

Signed and Sealed this

Ninth Day of September, 2003

JAMES E. ROGAN
*Director of the United States Patent and Trademark Office*